US006311360B1

(12) United States Patent
Lanvers

(10) Patent No.: US 6,311,360 B1
(45) Date of Patent: Nov. 6, 2001

(54) BRUSH AND METHOD OF PRODUCING THE SAME

(75) Inventor: Andreas Lanvers, Bad Honnef (DE)

(73) Assignee: M + C Schiffer GmbH, Neustadt (DE)

( * ) Notice: Subject to any disclaimer, the term of this patent is extended or adjusted under 35 U.S.C. 154(b) by 0 days.

(21) Appl. No.: 09/215,162

(22) Filed: Dec. 18, 1998

(30) Foreign Application Priority Data

Jun. 27, 1996 (EP) ..... PCT/EP96/02822

(51) Int. Cl.[7] ..... A46B 3/16
(52) U.S. Cl. ..... 15/191.1; 15/167.1; 300/21
(58) Field of Search ..... 15/167.1, 191.1, 15/195, 168; 300/21

(56) References Cited

U.S. PATENT DOCUMENTS

| | | | |
|---|---|---|---|
| 668,361 | * | 2/1901 | Tesch . |
| 1,370,343 | * | 3/1921 | Montgomery . |
| 1,448,744 | * | 3/1923 | Hastings . |
| 1,770,195 | * | 7/1930 | Burlew . |
| 1,826,267 | * | 10/1931 | White . |
| 2,244,098 | * | 6/1941 | Busick . |
| 2,685,703 | * | 8/1954 | Dellenbach . |
| 2,882,544 | * | 4/1959 | Hadidian . |
| 4,128,910 | | 12/1978 | Nakata . |
| 5,088,145 | * | 2/1992 | Whitefield . |
| 5,269,038 | * | 12/1993 | Bradley . |
| 5,799,354 | * | 9/1998 | Amir . |
| 5,970,564 | * | 10/1999 | Inns et al. . |
| 6,009,589 | * | 1/2000 | Driesen et al. . |
| 6,036,277 | * | 3/2000 | Weihrauch . |

FOREIGN PATENT DOCUMENTS

| | | | |
|---|---|---|---|
| 460705 | * | 10/1968 | (CH) . |
| 538 075 | | 11/1931 | (DE) . |
| 30 23 745 | | 1/1981 | (DE) . |
| 41 01 366 | | 8/1991 | (DE) . |
| 94 08 268.5 | | 8/1994 | (DE) . |
| 88569 | * | 2/1967 | (FR) . |
| 1024118 | | 3/1966 | (GB) . |

* cited by examiner

*Primary Examiner*—Deborah Jones
*Assistant Examiner*—Jennifer McNeil
(74) *Attorney, Agent, or Firm*—Laubscher & Laubscher

(57) ABSTRACT

A brush, preferably a toothbrush, comprises a brush body and at least one bundle of flexible bristes. At least one supporting element is provided on the brush body for laterally supporting at least one bundle of bristles. This improves the service life of the bundles of bristles, allowing a prolonged use of the brush and a sufficiently high flexibility of the bristles or bundles of bristles at the same time. A method of producing the brush is also indicated.

8 Claims, 4 Drawing Sheets

BRUSH AND METHOD OF PRODUCING THE SAME

BACKGROUND OF THE INVENTION

1. Field of the Invention

The present invention relates to a method of producing a brush, in particular a toothbrush, comprising a brush body carrying bundles of bristles, with the bundles of bristles consisting of plastic bristles. Furthermore, the present invention relates to a brush, in particular a toothbrush, comprising a brush body carrying bundles of bristles, with the bundles of bristles which consist of plastic bristles being surrounded at least in part by sleeve-like supporting elements.

2. Brief Description of the Prior Art

A brush of the above-mentioned type is known from German patent specification 538 075. In this type of toothbrush, bundles of bristles are received in rubber sleeves which are inserted into a basic body and enclose bundles of natural bristles or animal hair. In the toothbrush which is known from the prior art, the rubber sleeves are inserted into a basic body. Thus, considerable efforts are needed for producing the prior-art toothbrush. Moreover, the prior-art toothbrush has the disadvantage that dirt and/or bacteria may get stuck between the basic body and the rubber sleeves which are inserted into said body. Hence, the prior-art toothbrush does not meet today's hygienic requirements.

SUMMARY OF THE INVENTION

Starting from the above, it is the object of the present invention to provide a method of producing a brush, with the help of which brushes, in particular toothbrushes, can be produced economically that satisfy todays hygienic demands. Furthermore, it is the object of the present invention to provide a brush, and in particular a toothbrush of the above-mentioned type, which can be produced economically and offers resistance to a spreading apart of the bundles of bristles at its ends provided at the use side, which spreading apart reduces the usability of the brush and is not to be recommended medicinally in toothbrushes.

Thanks to the use of supporting elements, a wear-induced and permanent deviation of the outer bristles from the originally intended position is made impossible, at least in the area of the support, so that in comparison with a brush having the same degree of wear, but being without any support, there will be a reduced spreading apart at the end of use of the bundles of bristles, and thus a longer service life of the brush.

Therefore, with the solution of the invention, it is possible to use softer bristles or bundles of bristles than has so far been the case, with the supporting elements being integral with the brush body by way of injection molding, and slits, or the like, in which dirt or bacteria might get stuck being therefore absent in particular, thinner bristles or also softer bristle materials, or also a combination of the two, can now be used. As a result, the teeth can be brushed more gently and above all much more thoroughly and the risk of injuring the oral cavity, and above all the gum, is reduced. Moreover, the deformation of the bristles which is clearly felt by the user while he is brushing his teeth will reduce an excessively high contact pressure during brushing because an excessively strong deformation of the bundles of bristles will automatically be recognized by the user as wrong and will be corrected immediately. Thus the brush according to the invention supports a medicinally correct brushing of the teeth. Moreover, the brushing operation becomes more efficient because the number of bristles per bundle can be increased by using thinner bristles, and thus more bristle ends are efficiently operative. Preferably, the bundles of bristles are supported laterally in an elastic manner.

The invention can be used both in brushes with one bundle of bristles and in brushes comprising a plurality of bristle bundles. The use of the brush according to the invention, however, is not limited to the dental or cosmetic field. Rather, such brushes can be used in all walks of everyday life and in all technical fields, preferably in areas where a particularly gentle cleaning of relief-like surface formations is required and/or a particularly long service life of the bristles is desired.

Preferably, a separate supporting element is provided for each bundle of bristles. With a corresponding selection of the supporting element as to its shape and its deformation capacity, this makes it possible to adjust the bending characteristic of individual bundles of bristles individually. For instance, on a toothbrush having several rows of bristle bundles, the exterior bundles of bristles or the front bundles of bristles can be supported by supporting elements of a higher stiffness than the remaining ones. It is also possible to support just a part of the bundles of bristles by means of supporting elements and to leave the remaining ones in an unsupported state.

According to a further advantageous embodiment of the invention, a plurality or all of the supporting elements are integrally interconnected and mounted on the brush body as a supporting unit. Apart from the fact that the shape and deformation capacity of the respective supporting element of a bundle of bristles can be adjusted individually, an integral design will permit an easier production of the supporting elements because according to the invention these are produced in an injection-molding process.

Preferably, the supporting element comprises an elastic sleeve section in which a bristle receiving opening extends, as well as a base section through which the sleeve section is connected to the brush body. In contrast to a supporting of the bundles of bristles in a solid-material body, e.g. of a supporting plate having a constant thickness, with supporting regions around the individual bundles of bristles, a more exact adjustment of directionally dependent deformation characteristics of the respective supporting element and a higher degree of deformation can be achieved through the configuration of sleeve-like supporting elements. The contact surface between the brush body and the supporting element can be increased by a flange-like extension of the base section of the supporting element to prevent detachment of the supporting element in a still improved manner.

Preferably, the bundles of bristles are secured in the brush body, with the individual bundles of bristles extending through the respective supporting elements.

Alternatively, the bundles of bristles can only be secured in the supporting elements, whereby adhesion by way of bonding is achieved between the bundles of bristles and the supporting elements.

Preferably, the sleeve section or the outer contour thereof can have a substantially cylindrical shape. When the supporting element(s) is (are) produced in one mold, one skilled in the art will provide the necessary mold inclinations and curvatures for achieving easier removal from the mold.

Alternatively, the sleeve section can be designed such that its wall thickness tapers towards the end of use of the bristles. The bending characteristic of the system bundle of bristles/support element can thereby be influenced in a desired manner. The shape of the outer sleeve can be adapted to the requirements of a desired bending line of the bundle of bristles or individual bristles.

According to an advantageous embodiment of the invention several or all of the supporting elements are interconnected through their base sections to form an integral supporting element The brush body can be entirely covered at its bristle side by the integral supporting elements, resulting in a homogeneous appearance and a high detachment resistance of the supporting elements. Moreover, such an integral supporting element can be produced in a particularly efficient manner.

Between the brush body and the respective base section of the supporting element there may be provided a surface formation for increasing the contact surface between the two members so as to improve detachment resistance. A corresponding increase in the surface can e.g. be achieved through a corrugation on one or both members. The provision of grooves, ribs, perforated patterns or the like could be mentioned as further examples of increasing the contact surface.

One possibility consists in folding a bundle of bristles and in subsequently fixing the folded end by means of an anchoring part in the brush body. The anchoring part, e.g. a plate-shaped metal or plastic part can be inserted, e.g. punched, together with the bundle of bristles wound thereabound into an opening provided on the brush body. Alternatively, the brush can be provided with bristles such that the ends of the bundles of bristles which are to be secured are molten, resulting in the formation of thickened portions. The thickened portions are then coated by injection-molding with brush body material or with supporting element material, whereby the bundles of bristles are positively held.

The brush can be produced in a two-component injection-molding process, with the brush body consisting of a rigid plastic component and the supporting elements as bristle enclosing means preferably of a non-rigid plastic component, e.g. of a thermoplastic elastomer, but they can also be made from a rigid component. Ideally, adhesion by way of bonding is achieved between the rigid component of the brush body and the supporting element(s). With a corresponding material selection, brush body and supporting elements can be produced in successive manufacturing steps in one single molding tool.

BRIEF DESCRIPTION OF THE DRAWINGS

Further features and advantages of the present invention can be gathered from the following description of embodiments in combination with the drawing, in which.

DETAILED DESCRIPTION

Figure 1:
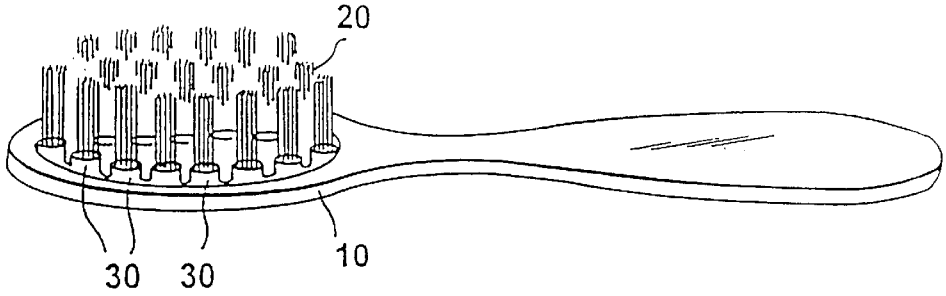
FIG. 1 is a total view of a brush in the form of a toothbrush, according to the invention.
Figure 2A:
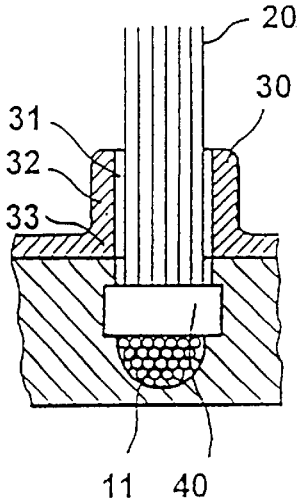
FIG. 2*a* is a sectional view through the brush body and a supporting element with an inserted bundle of bristles.
Figure 2B:
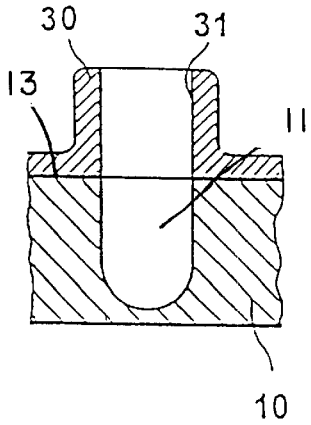
FIG. 2*b* is the same view as in FIG. 2*a*, but prior to the insertion of the bundle of bristles.
Figure 2C:
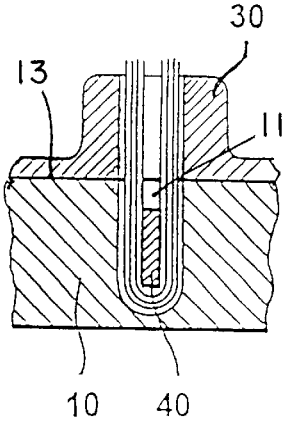
FIG. 2*c* is a section through the bundle of bristles, the section being offset by 90° in comparison with FIG. 2*a;*

A first embodiment shall now be explained by way of FIGS. 2*a* to *c*, reference being made to a toothbrush having a plurality of bundles of bristles, as is shown in FIG. 1.

A brush body 10 which can be made integral with the handle of the brush is provided with a plurality of blind holes 11 that can be produced in any desired manner. Each of the blind holes 11 serves to receive a bundle of bristles 20 that consists of a plurality of preferably thin, flexible bristles made of a plastic material. This bundle of bristles 20 is folded or wound around an anchoring part 40 so that all bristle ends are oriented in one direction. Each bundle of bristles is clamped in its blind hole 11 by the anchoring part 40 which is secured in the brush body 11. The anchoring part is here designed as a small flat plate which with respect to the blind hole 11 is punched substantially upright into the brush body 10.

Figure 6A:
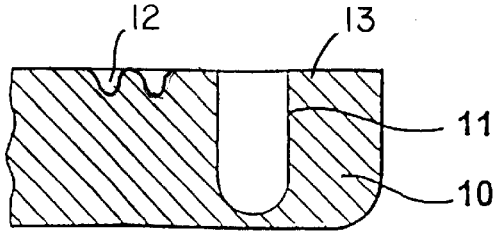
FIGS. 6*a*–6*d* shows the step of a method of producing a brush according to one of FIGS. 1 to 5.
Figure 6B:
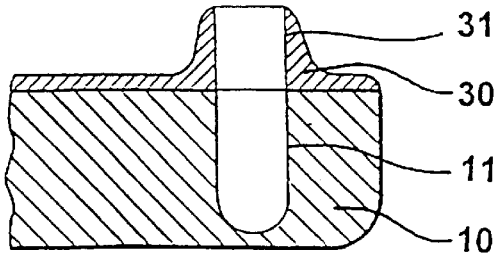
Figure 6C:
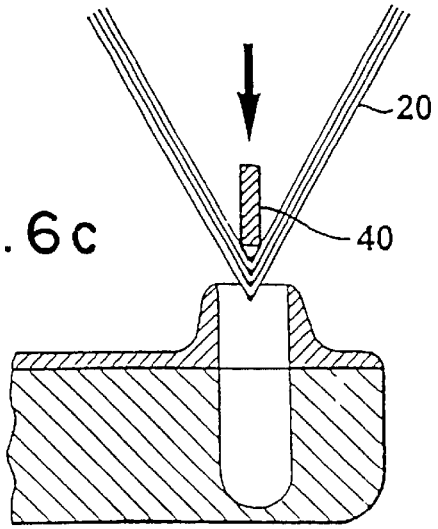
Figure 6D:
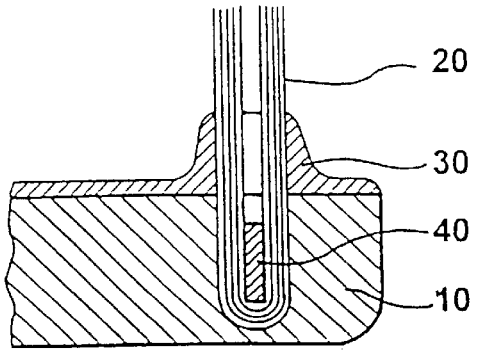

A supporting element 30 is mounted on the bristle side 13 of the brush body for each bundle of bristles 20. The embodiment of the supporting element which is shown in FIGS. 2*a* to 2*c* has a bristle receiving opening 31 for laterally supporting the bundle of bristles 20. Preferably, the bristle bundles are supported up to about half their length. The supporting element 30 comprises a sleeve section or portion 32 which is elastically deformable, in particular in radial direction, and a base section 33 which extends in the manner of a flange portion in radial direction beyond the sleeve section 32. The respective supporting element 30 is connected to the brush body 10 via said base section 33. In the embodiment which is shown in FIGS. 2*a* to 2*c*, the bristle receiving opening 31 extends through the sleeve section 32 and the base section 33. Preferably, a surface formation is provided between the supporting element 30 or its base section 33 and the brush body 10 for increasing the contact surface between the two members so as to further enhance the detachment resistance of the respective supporting element This can be accomplished through a corrugation or by providing grooves, ribs, perforated patterns 12 (FIG. 6*a*), or the like, on one or both of the contact surfaces. Adhesion by way of bonding can be achieved between the supporting elements 30 or their base sections 33 and the brush body when a corresponding material is selected and suitable manufacturing parameters exist.

The individual supporting elements are connected to one another through their base sections 33 to form an integral supporting element and to fully cover the brush body at the bristle side in the area of the bristles.

In the embodiment of the supporting element as is shown in FIGS. 2*a* through 2*c*, the sleeve section 32 has a substantially cylindrical shape, whereby bending characteristics which are similar in all directions are obtained for the bundle of bristles. The bending characteristics of the system bundle of bristles/supporting element can be varied in the desired manner and in accordance with the respective requirements by correspondingly designing the wall thickness of the sleeve section 32 and by arranging the bundle of bristles 20 in the bristle receiving opening 31. With an eccentric arrangement of the bundle of bristles in the sleeve section 32, as is shown in the bundles of bristles shown at the right side in FIG. 5, the exterior bundles of bristles, and here in particular the outer bristles thereof, can be supported to a greater degree than the interior bristles or bundles of bristles, so that the service life of the most highly stressed bristles is further improved. In the embodiment shown in FIGS. 2*a* to 2*c*, in order to influence the directional dependence of the bending characteristics of the bundle of bristles 20, there may just be a partial lateral support by the bristle receiving opening 31, as is shown in the right bundle of bristles in FIG. 4.

Figure 3:
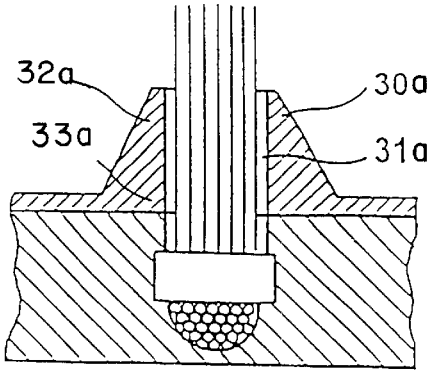
FIG. 3 shows a second embodiment of the supporting element.

A further embodiment of the supporting element 30 is shown in FIG. 3. This supporting element differs from the form shown in FIG. 2*a*, in particular by its substantially frustoconical design. Thanks to a decreasing wall thickness towards the end of the bristles, the bending characteristics of the system bundle of bristles/supporting element can be made even more homogeneous than in the previously described embodiment. In particular, the load on the individual bristles in the exit portion from the supporting element 30*a* can be further reduced. Moreover, the conical design in the transition area from the sleeve section 32*a* to the base section 33*a* leads to a reduced notch effect, so that the stability of the supporting element 30*a* can be further improved.

A separate supporting element 30*a* which is separated from the supporting elements of the other bundles of bristles may be provided for each bundle of bristles.

Figure 4:
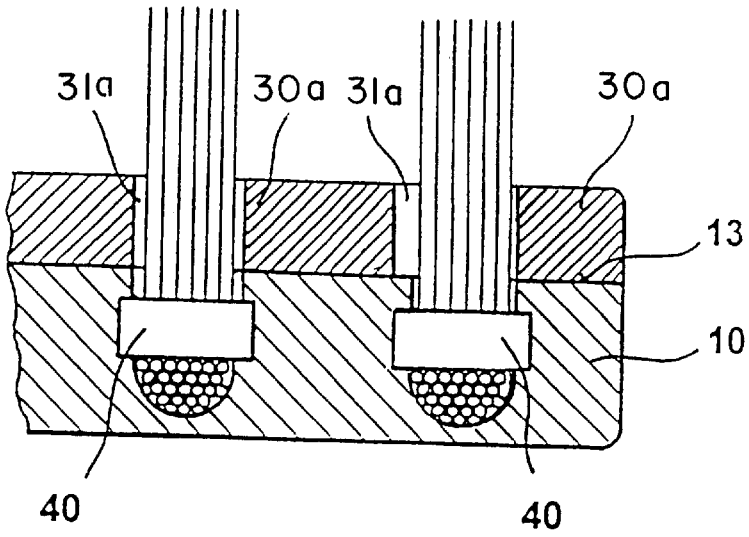
FIG. 4 shows a third embodiment of the supporting element.
Figure 5:
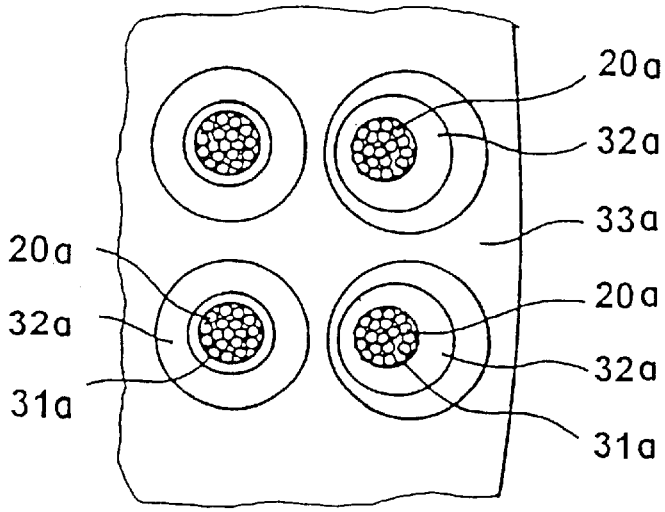
FIG. 5 is a partial view of a top view on the bristle ends.

A further embodiment of the supporting elements 30*b* is shown in FIG. 4, the elements being here made integral with a solid-material body. From the outside, this gives the impression of a conventional brush which, however, has the already described advantages of the preferably elastic lateral support of the bundles of bristles 20. As shown by way of example in the bundle of bristles at the right side in FIG. 4, the bundle may also be supported only in part at the side to achieve a directionally dependent bending characteristic.

The method of producing a brush according to an embodiment illustrated in FIGS. 2 to 4 shall now be described in more detail with reference to FIG. 6. The brush body 10 which is already provided with blind holes 11 and which is preferably injection-molded from a rigid plastic component has mounted thereon the supporting elements 30, for example by injection molding, or also by using a gluing method or a similar method, resulting in a deeper blind hole. A two-component injection-molding process is preferably used for a simple and efficient manufacture of the brush body and the supporting elements. The supporting elements 30 are made from a non-rigid plastic component for achieving sufficiently elastic supporting elements 30. This leads to a blind hole whose upper wall section has an elasticity which is higher for a lateral support of the bristles, and whose lower part is sufficiently strong to secure the anchoring part 40. The brush body 10 which is already connected to the supporting elements will then be provided with bristles by driving the anchoring part 40 with the bristles or bundles of bristles folded therearound through the respective supporting element 30 into the brush body 10 and by securing or damping the anchoring part and thus the bundle of bristles 20.

Figure 7:
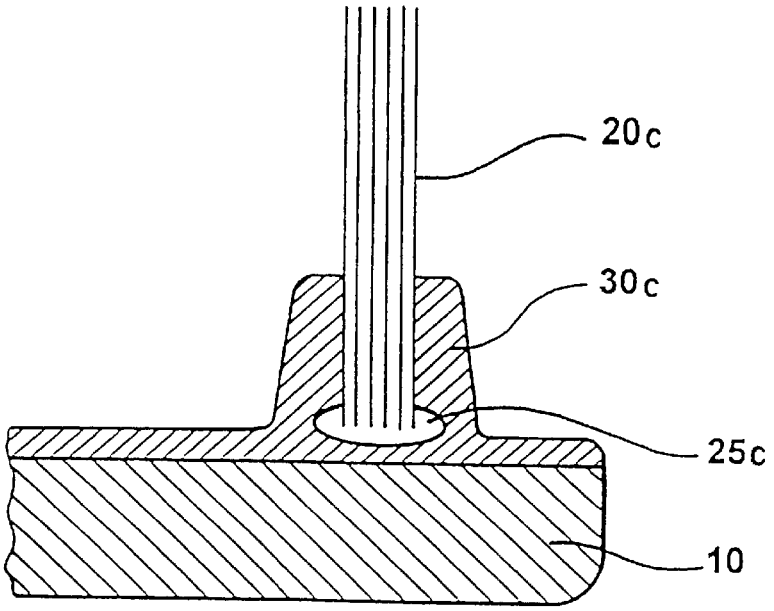
FIG. 7 shows a further embodiment of the invention in which the bundles of bristles are each secured with a molten end in the supporting element.
Figure 8:
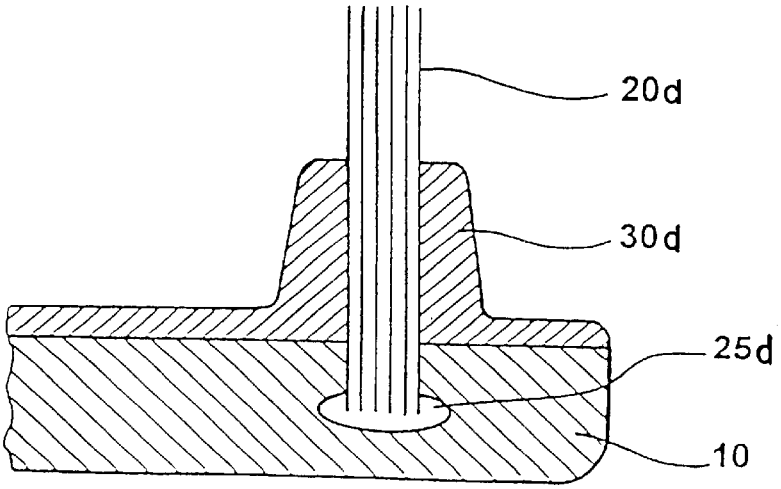
FIG. 8 shows a further embodiment of the invention in which the bundles of bristles are each secured with a molten end in the brush body.

Two further embodiments of the present invention are shown in FIGS. 7 and 8. The bundle of bristles 20 is provided at its end to be anchored with a thickened portion 25 of partly molten bristle material which guarantees a sufficient anti withdrawal force for the bundle.

In the embodiment which is shown in FIG. 7, it is only the thickened portion 25*c* of the bundles of bristles 20*c* which is received in the bristle receiving opening 31*c* of the respective supporting element 30*c*, i.e. the bundles of bristles are secured in the supporting elements. To increase the ant withdrawal force for the bundle, the bristle material and the material of the supporting elements are chosen such that adhesion by way of bonding is achieved.

For the production of such a brush by means of a two-component injection-molding process, the bundles of bristles 20*c* are molten at their end to be anchored in the supporting element 30*c* so that mushroom4ike thickened portions 25*c* are formed. The thickened portions are then coated by injection molding with supporting-element material that encloses the thickened portions. Subsequently, the supporting elements are connected to the brush body which can e.g. be injection-molded onto the supporting elements).

In a further embodiment, which is shown in FIG. 8, the thickened ends of the bundles of bristles 20*d* are secured in the brush body 10. To this end, the individual bundles of bristles 20*d* are e.g. introduced into prefabricated supporting elements 30*d*, so that the thickened portions 25 of the individual bundles of bristles 20*d* project from the supporting elements 30. The thickened portions are then coated by way of injection molding with a rigid plastic component which forms the brush body 10.

An elastic lateral support of the bundles of bristles 20 by the supporting elements 30 is also possible by way of a rigid plastic component (material) the elasticity of which can be achieved through the design shape of the individual supporting elements 30. Preferably, however, use is made of non-rigid plastic components having a Shore-A hardness of less than 70.

The term two-mponent method is not limited to the use of different materials, but covers the possibility that the same material is e.g. used with different colors.

What is claimed is:

1. A method of producing a toothbrush including a body portion, a support layer portion on said body portion, and a plurality of bundles of synthetic plastic bristles supported by at least one of said body and support layer portions, comprising:

(a) melting a first end of each of said bristle bundles to form a thickened bristle bundle end portion;

(b) injection molding a support layer at least partially around each of said bristle bundles adjacent said first end, said bristle bundles having exposed second ends that extend from one face of said support layer; and (c) injection molding a body layer in secured relation to the face of said support layer remote from said first face;

(d) said injection molding steps causing said bristle bundle enlarged end portions to be embedded and positively held in the associated one of said body and support layers.

2. A method of producing a toothbrush as defined in claim 1, wherein said support layer completely encloses the thickened bundle end portions to embed and positively hold the same in said support layer.

3. A method of producing a toothbrush as defined in claim 1, wherein said support layer encloses only an intermediate portion of each of said bundles adjacent the thickened end portion thereof; and further wherein said bristle bundle thickened end portions are embedded and positively held in said body layer.

4. A method of producing a toothbrush as defined in claim 1, wherein said support layer is formed from a non-rigid elastic synthetic plastic material, and said brush body layer is formed from a rigid synthetic plastic material, said support layer including for each bristle bundle a tubular elastic support sleeve portion that projects concentrically about the bristle bundle and tapers inwardly in the direction of the free second end thereof.

5. A toothbrush, comprising:

(a) a plurality of bundles of synthetic plastic bristles (20*c*, 20*d*) arranged in parallel spaced relation, said bristle bundles having corresponding first ends that are melted to form enlarged end portions (25*c*, 25*d*);

(b) a support layer (30*c*, 30*d*) of elastic non-rigid synthetic plastic material formed by injection molding about at least corresponding intermediate portions of said bristle bundles adjacent said enlarged first end portions, said bristle bundles having second ends that extend outwardly from a first face of said support layer; and (c) a body layer formed by injection molding a rigid synthetic plastic layer on the face of said support layer that is remote from said first face, said bristle bundle enlarged end portions being embedded and positively held in one of said layers.

6. A toothbrush as defined in claim 5, wherein said bristle bundle enlarged end portions (25*c*) are embedded in said support layer.

7. A toothbrush as defined in claim 5, wherein said bristle bundle first ends extend through said support layer, and wherein said enlarged bristle bundle end portions (25*d*) are embedded in said body layer.

8. A toothbrush is defined in claim 5, wherein said support layer has for each bristle bundle a tubular elastic support sleeve portion that projects concentrically about an intermediate portion of the associated bristle bundle, each of said sleeve portions being tapered inwardly in the direction of the bristle bundle second end.

* * * * *